US008346156B2

(12) United States Patent
Ueda

(10) Patent No.: US 8,346,156 B2
(45) Date of Patent: Jan. 1, 2013

(54) IMAGE FORMING APPARATUS HAVING A BOOKBINDING APPARATUS ATTACHABLE THERETO WHEREIN A HEATER OF THE BOOKBINDING APPARATUS IS CONTROLLED BASED ON A DETECTION RESULT OF A TEMPERATURE DETECTION SECTION AND AN INPUT SECTION

(75) Inventor: Hiroki Ueda, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 754 days.

(21) Appl. No.: 12/034,014

(22) Filed: Feb. 20, 2008

(65) Prior Publication Data

US 2009/0067950 A1 Mar. 12, 2009

(30) Foreign Application Priority Data

Sep. 12, 2007 (JP) ..... 2007-236363

(51) Int. Cl.
*G03G 15/00* (2006.01)

(52) U.S. Cl. ..... 399/408; 399/407; 412/8; 412/18; 412/37

(58) Field of Classification Search ..... 399/408; 412/8, 18, 37
See application file for complete search history.

(56) References Cited

U.S. PATENT DOCUMENTS

| | | | | |
|---|---|---|---|---|
| 4,525,116 | A * | 6/1985 | Holmberg | 412/8 |
| 7,346,309 | B2 * | 3/2008 | Nakamura et al. | 399/408 |
| 7,568,510 | B2 * | 8/2009 | Nagaya et al. | 156/359 |
| 7,605,931 | B2 * | 10/2009 | Sato et al. | 358/1.14 |
| 2007/0048109 | A1 * | 3/2007 | Fujii et al. | 412/33 |

FOREIGN PATENT DOCUMENTS

| | | |
|---|---|---|
| JP | 2007-22768 A | 2/2007 |
| JP | 2007-57580 A | 3/2007 |

OTHER PUBLICATIONS

Japanese Office Action dated Oct. 27, 2009 and English translation thereof issued in a counterpart Japanese Application No. 2007-236363.

* cited by examiner

*Primary Examiner* — Matthew G Marini
(74) *Attorney, Agent, or Firm* — Holtz, Holtz, Goodman & Chick, PC

(57) ABSTRACT

A bookbinding apparatus, which is capable of being attached to an image forming apparatus, and bookbinding by adhering a cover sheet onto a spine of a sheet bundle formed by a plurality of sheets on each of which an image has been formed by the image forming apparatus, the bookbinding apparatus including: a coating section for coating adhesive onto the spine of the sheet bundle; a heater for heating the adhesive; a temperature detection section for detecting temperature of the adhesive; an input section for receiving input from a user; and a heater control section for controlling the heater based on a detection result of the temperature detection section based on the input from the input section so that temperature of the adhesive becomes a predetermined control temperature, and changing a control condition of the heater.

10 Claims, 12 Drawing Sheets

IMAGE FORMING APPARATUS HAVING A BOOKBINDING APPARATUS ATTACHABLE THERETO WHEREIN A HEATER OF THE BOOKBINDING APPARATUS IS CONTROLLED BASED ON A DETECTION RESULT OF A TEMPERATURE DETECTION SECTION AND AN INPUT SECTION

RELATED APPLICATION

This application is based on Japanese Patent Application No. 2007-236363 filed on Sep. 12, 2007 in Japan Patent office, the entire content of which is hereby incorporated by reference.

TECHNICAL FIELD

The present invention relates to a bookbinding apparatus and an image forming system, which make a booklet by coating a sheet bundle and a cover sheet.

BACKGROUND

A bookbinding apparatus for simply conducting a wrap bookbinding process by wrapping a bundle of a plurality of sheets onto which images have been formed by a copying machine and a printer with a cover sheet in horseshoe-shape and adhering the spine of the bundle of the sheets and the cover sheet is known.

Heat melting type adhesive is used as adhesives used for such a bookbinding machine. Adhesive is stored in the adhesive tank, prior to conducting bookbinding, it is necessary to heat the adhesive with a heater beforehand to more than a predetermined temperature. There is a problem that heating to a predetermined temperature takes at least a certain amount of time.

In Unexamined Japanese Patent Application Publication No. 2007-22768, a bookbinding machine, which begins adhesive dissolution at the time of setting coating bookbinding job operations or a specified time, instead of starting adhesive dissolution at the time of conducting a coating bookbinding job for the first time has been disclosed.

However, there are problems when a predetermined preset temperature is maintained in order to maintain the adhesive in a dissolved state without bookbinding for a long period of time after ending the bookbinding job or after an appointed time, that consumption energy with an adhesive heater increases and that adhesive deteriorates. Further, in a small room, which cannot perform sufficient ventilation, there is a possibility that the bad smell generated from adhesive may become a problem.

To these problems, Unexamined Japanese Patent Application Publication No. 2007-57580 discloses a bookbinding apparatus, which changes heater temperature control mode according to the state of other image forming apparatus during processing of a bookbinding job to any one of (1) the temperature in which adhesion is possible, (2) a temperature lower than the temperature in which adhesion is possible, or (3) a state where heater is turned off.

However, with respect to the bookbinding machine which has been disclosed by Unexamined Japanese Patent Application Publication Nos. 2007-22768 and 2007-57580, the control of an adhesive heater is changed based on the conditions set up beforehand, and the control of the adhesive heater is not directly changed. Although it is possible to turn off the adhesive heater by turning off the electric power switch of the whole bookbinding machine, however, in such a case, all the functions of the bookbinding machine will stop simultaneously. There was a problem of taking time to use only the sheet ejection pathway, which does not perform a book binding, until initial communication or re-heating with a heater became usable again since all the functions had to be restarted.

SUMMARY

An aspect of the present invention is a bookbinding apparatus, which is capable of being attached to an image forming apparatus, and bookbinding by adhering a cover sheet onto a spine of a sheet bundle formed by a plurality of sheets on each of which an image has been formed by the image forming apparatus, the bookbinding apparatus comprising:

a coating section for coating adhesive onto the spine of the sheet bundle by moving relatively to the spine of the sheet bundle;

a heater for heating the adhesive;

a temperature detection section for detecting temperature of the adhesive;

an input section for receiving input from a user; and a heater control section for controlling the heater based on a detection result of the temperature detection section so that temperature of the adhesive becomes a predetermined control temperature, and changing a control condition of the heater based on the input from the input section.

And another aspect of the present invention is an image forming system comprising:

an image forming apparatus forming an image on a sheet; and a bookbinding apparatus which binds a book by adhering a cover sheet onto a spine of a sheet bundle formed by a plurality of sheets on each of which the image has been formed by the image forming apparatus, the bookbinding apparatus comprising, a coating section for coating adhesive onto the spine of the sheet bundle by moving relatively to the spine of the sheet bundle;

a heater for heating the adhesive;

a temperature detection section for detecting temperature of the adhesive, the image forming system further comprising:

an input section for receiving input from a user; and a heater control section for controlling the heater based on a detection result of the temperature detection section so that temperature of the adhesive becomes a predetermined control temperature, and changing a control condition of the heater based on the input from the input section.

PREFERRED EMBODIMENT OF THE INVENTION

Although the present invention is explained based on an embodiment of the invention, the present invention is not limited to this embodiment of the invention.

Figure 1:
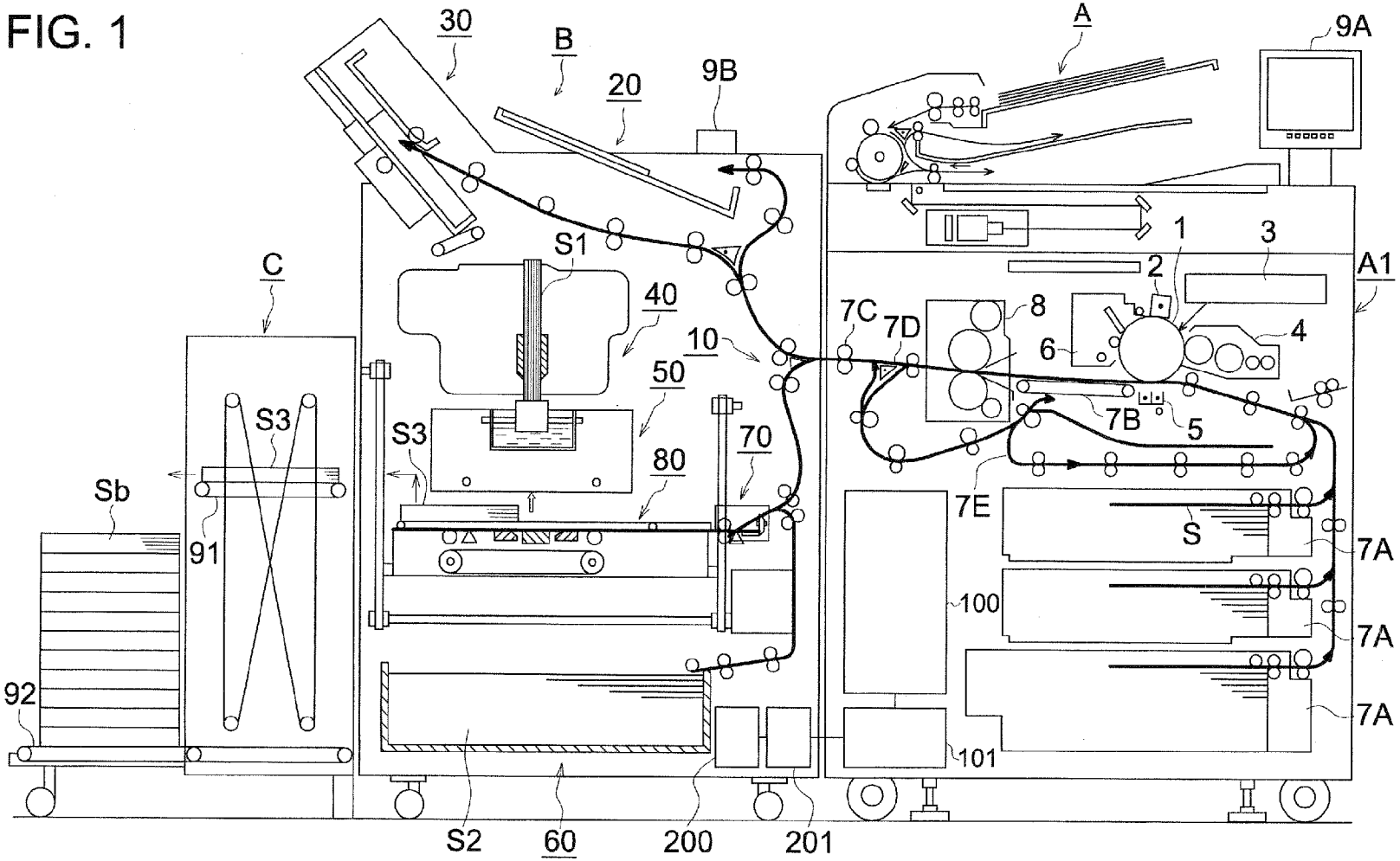
FIG. 1 illustrates an entire configuration of the image forming system including an image forming apparatus A, a bookbinding apparatus (Post processing apparatus) B, and a booklet storage apparatus C.

FIG. 1 is an entire configuration figure of the bookbinding system equipped with the image forming apparatus A, the bookbinding apparatus (post processing apparatus) B, and the booklet storage apparatus C.

[Image Forming Apparatus A]

The image forming apparatus A includes an image forming device, in which an electrostatic charge device 2, an image exposure device 3, a development device 4, a transfer electric discharge device 5, and a cleaning device 6 are arranged around the rotating image carrier 1. After the image forming device performs uniform charging on a front surface of the image carrier 1 by the charging device 2, the exposure scanning by the laser beam of the image exposure device 3 based on the image data read from a document is performed, and a latent image is formed. A reversal development of this latent image is performed by the development device 4, and a toner image is formed on the front surface of the image carrier 1.

A sheet S, which was a sheet fed from a sheet feeding tray 7A, is sent to a transfer position. After a toner image has been transferred onto the sheet S by the transfer electric discharge device 5 in the transfer position, the electric charge of Sheet S is eliminated, and separated from the image carrier 1. The sheet S is conveyed by the conveyance device 7B, continually heated and fixed by the fixing device 8, and ejected from sheet ejection rollers 7C.

When performing an image forming onto both surfaces of the sheet S, the sheet S heated and fixed by the fixing device 8 is diverged from the normal sheet ejection pathway by the conveyance path switching device 7D. After switch backing and reversing in the reverse conveyance device 7E, the sheet S passes through the image forming section again, and an image is formed on the back surface of the Sheet S. Then, through the fixing device 8, the sheet S is ejected out of an apparatus from the sheet ejection rollers 7C. The sheet S ejected from the sheet ejection rollers 7C is sent into the bookbinding apparatus B.

The front surface of the image carrier 1 after the image processing prepares for the following image forming, after the development agent remaining on the front surface is removed by the cleaning device 6.

An operation display section 9A is disposed on the upper section of the image forming apparatus A. The operation display section 9A includes the input section of the touch panel, onto which the touch screen has been superimposed to the display section configured by a liquid crystal panel, and the operation display section 9A functions as an input section and a display section.

[Bookbinding Apparatus B]

Figure 2:
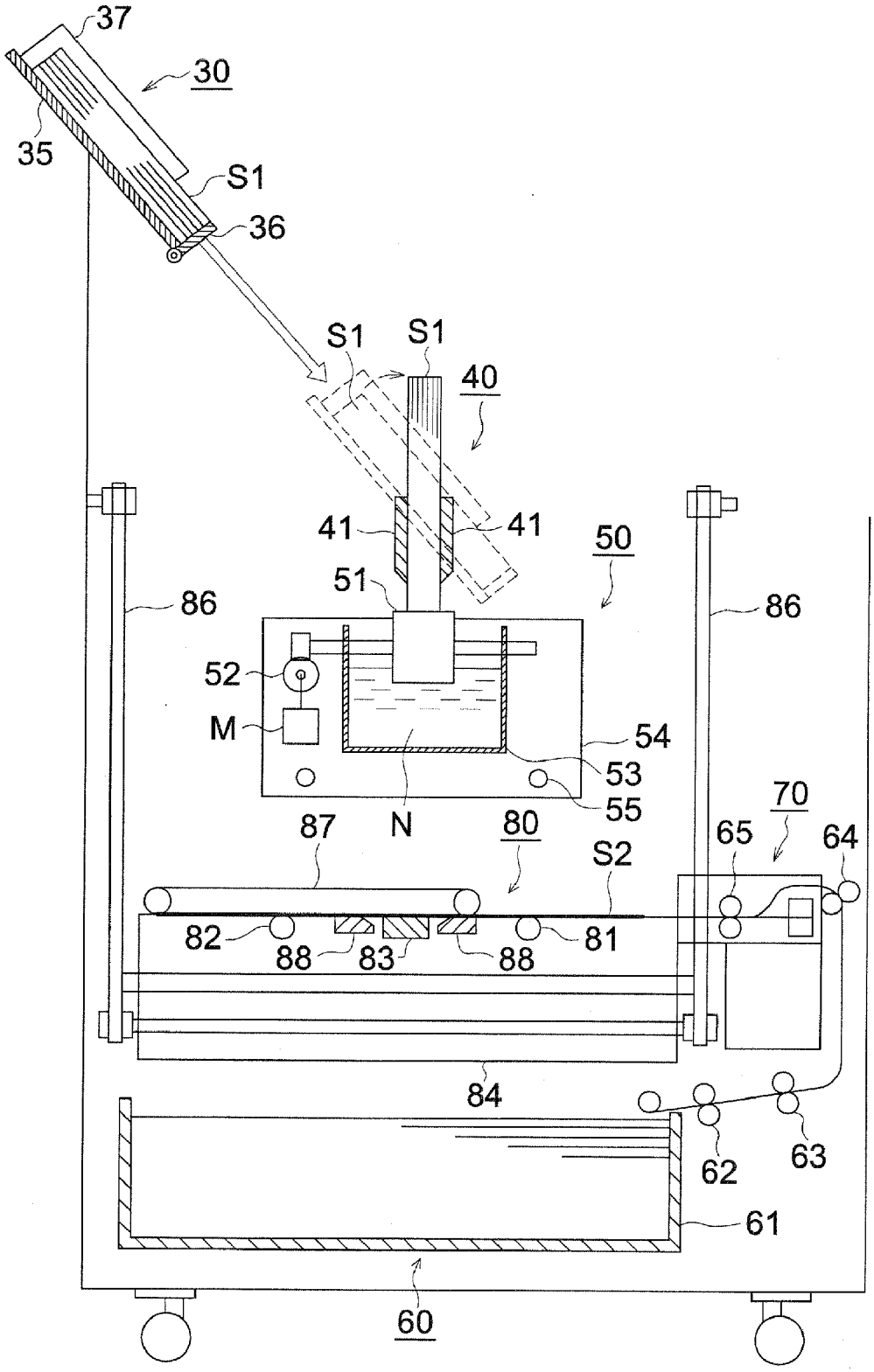
FIG. 2 illustrates a sectional view of the bookbinding apparatus B.

FIGS. 1 and 2 explain a bookbinding processing of a bookbinding apparatus. As shown in FIG. 1, the bookbinding apparatus B pertaining to the present invention includes a sheet conveyance device 10, a sub sheet ejection section 20 (sub sheet ejection mechanism), a sheet bundle storage device 30, a sheet bundle conveyance device 40, a coating section 50, a cover sheet supplying section 60, a cover sheet cutting device 70, and a cover sheet supporting device 80. Each of these devices is vertically disposed in almost perpendicular direction of the bookbinding apparatus B.

An operation display section 9B is disposed on the upper section of the bookbinding apparatus B. The operation display section 9B includes the input section of the touch panel, onto which the touch screen has been superimposed to the display section configured by a liquid crystal panel, and the operation display section 9B functions as an input section and a display section. In place of the operation display section 9B, a hard switch of a dial-type may be provided, which may function as the input section.

The sheet S to which the image forming has been performed in the image forming apparatus A is conveyed by the sheet conveyance device 10, and a sheet bundle S1 is formed by accumulating a plurality of sheets S by the sheet bundle storage device 30. The sheet bundle S1 is conveyed to a predetermined position by the sheet bundle conveyance device 40, after the adhesive has been coated to a spine of the sheet bundle S1 by the coating section 50, the sheet bundle S1 is adhered with a cover sheet S2 supported by the cover sheet support device 80, and bookbinding processing is performed. It is explained hereafter.

The sheet S taken into the sheet conveyance device 10 is conveyed to any one of the sub sheet ejection section 20, the sheet bundle storage device 30, and the cover sheet support device 80 by a plurality of conveyance rollers and a conveyance path switching gate.

In case when the sheet conveyance to the sub sheet ejection section 20 functioning as "sub sheet ejection mechanism" is set, the sheet S ejected from the image forming apparatus A is directly received at the sheet ejection tray of the sheet ejection section 20 by a setting of the conveyance path switching gate. On the sheet ejection tray, a maximum of about 200 sheets can be loaded. And the sub sheet ejection section 20 has an independent sheet ejection pathway from the coating section 50. Moreover, even if it is in the state where the bookbinding process cannot be performed, since the adhesive of the coating section 50 has not reached to a predetermined temperature and the adhesive has not melted enough, the sub sheet ejection section 20 is able to function independently, and is able to convey the sheet S from the image forming apparatus A.

The sheet bundle storage device 30 forms the sheet bundle S1 by bundling a predetermined number of sheets S ejected from the image forming apparatus A. FIG. 2 is a sectional view of the bookbinding apparatus B. As shown in FIG. 2, the sheet bundle storage device 30 includes a sheet place table 35 disposed in an inclined position, a sheet rear edge positioning member 36, which is movable, and an adjustment member 37 for adjusting the width direction of the sheet.

As shown in FIG. 2, the sheet bundle S1 loaded on the sheet place table 35 of the sheet bundle storage device 30 is gripped by the grip device 41 after being adjusted. The sheet rear edge positioning member 36 is shaken by a drive section not illustrated, and shunts under the sheet place table 35. The grip device 41, which has gripped the sheet bundle S1, rotates after moving into diagonally lower direction shown in the figure with the dashed line, and held in upright state so as the spine of the sheet bundle S1 onto which an adhesive agent coating process is performed will be downward, and stops at a predetermined position.

On the other hand, the cover sheet S2 stored in the cover sheet loading device 61 of the cover sheet supplying device 60 is separated and fed by the sheet feeding device 62, and imposed by conveyance rollers, 63, 64 and 65. The cover sheet S2 is conveyed by conveyance rollers 81 and 82 of a cover sheet supporting device 80 and stopped at a predetermined position.

The cutting of the cover sheet S2 is performed in a cover sheet cutting device 70 disposed on the right of the conveyance rollers 65 in FIG. 2. In case when the cover sheet S2 is longer than a required length when performing a wrap bookbinding process to the sheet bundle S1, an excessive section is cut in advance.

[Coating Section]

In the coating section 50, symbol 51 denotes a coating roller for coating the adhesive. Symbol 53 denotes an adhesive container for storing the adhesive, and symbol 54 denotes a movable body for supporting these. A heater H is provided on the outer circumference of the adhesive container 53, and an inner section of the coating roller 51 include. The adhesive inside the adhesive container 53 is in a molten state by heating the adhesive in the adhesive container 53 to a prescribed temperature. The predetermined thickness of the adhesive N is coated onto the spine of the sheet bundle S1 by the rotating coating roller 51 while reciprocally moving the moving body 54 in the longitudinal direction of the spine of the sheet bundle S1.

After coating the adhesive to the sheet bundle S1, a raising and lowering device 86 moves a moving case 84 to the raised position as a predetermined position by the drive device not illustrated. In this raised position, a center section of the cover sheet S2 placed on a pressuring member 83 is pressed against the coating surface of the sheet bundle S1, and adhered.

After adhering the cover sheet S2 onto the sheet bundle S1 onto which the adhesive N is pasted, the cover sheet S2 is folded along the sheet bundle S1. The folding folds the cover sheet S2 pasted to the spine of the sheet bundle S1 along the spine side by an operation of one pair of folding members 88, which moves vertically and horizontally. A booklet S3 is formed of the above.

The booklet S3 ejected by an ejection belt 87 is placed on a conveyance belt 91 capable of raising and lowering in a booklet storage apparatus C shown in FIG. 1. The booklet S3 is sequentially ejected by the rotation of the conveyance belt 91, and is loaded and stored on a sheet ejection tray 92.

Figure 3:
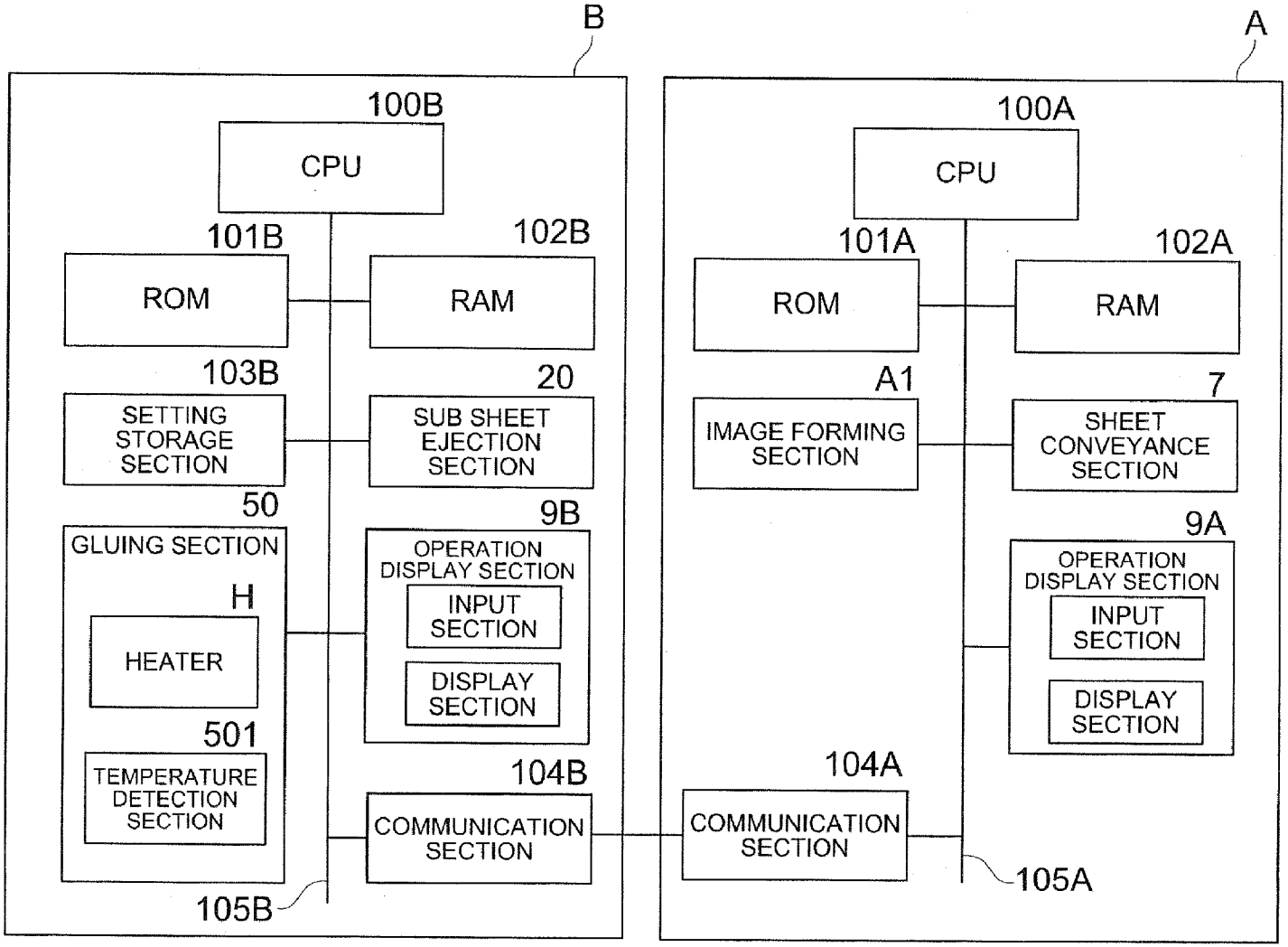
FIG. 3 illustrates a control block diagram of the image forming system.

FIG. 3 illustrates a control block diagram of the image forming system. In addition, in FIG. 3, the surroundings of a section necessary for explanation of this embodiment is indicated in focus, and regarding the section known as other image forming systems is omitted. Moreover, in figure hereinafter, in order to avoid repetition of explanation, the explanation of a section in common is replaced by attaching the same symbol.

A symbol 100B denotes a CPU and functions as a control device for executing various controls of the bookbinding apparatus B according to a program. The symbol 101B denotes a ROM and stores the various program and data containing the program and data for controlling the bookbinding apparatus B. A symbol 102B denotes a RAM and used as a work area by the CPU 100A. The symbol 102B temporarily stores program and data necessary when the CPU 100B executes a control of the image forming apparatus A. And the CPU 100B executes the control of the bookbinding apparatus B based on the program and the data extracted by the RAM 102B. And the CPU 100B also functions as a heater control section. A symbol 103B denotes a setting storage section for storing a control condition.

The heater H is provided on the outer circumference section of the adhesive container 53 of the coating section 50, and in the inner section of the coating roller 51, and the temperature is detected by a temperature detection sensor 501 provided in the adhesive container 53.

A symbol 9B denotes an operation display section. The symbol 9B is configured by a touch panel, and various operation screens are displayed and an instruction input is performed. A symbol 104B denotes a communication section. The symbol 104B is connected to the image forming apparatus A, and transmits and receives various data between the image forming apparatus A. A symbol 105B denotes a bus, and the CPU 101B, the ROM 101B, the RAM 102B, the operation display section 9B, the sub sheet ejection section 20 and the communication section 104B are connected to one another by the bus 105B.

A ROM 101A, a RAM 102A, an image forming section A1, a sheet conveyance section 7, and a communication section 104A are connected to one another by a bus 105A centering on a CPU 100A for executing various controls of the image forming apparatus A according to the program in the image forming apparatus A.

In the image forming apparatus A, in case when the bookbinding print job for performing the bookbinding process is inputted, the information is transmitted to the bookbinding apparatus B through the communication sections 104A and 104B. In the bookbinding apparatus B, a preparation for receiving the bookbinding process is performed based on the received information.

Figure 4:
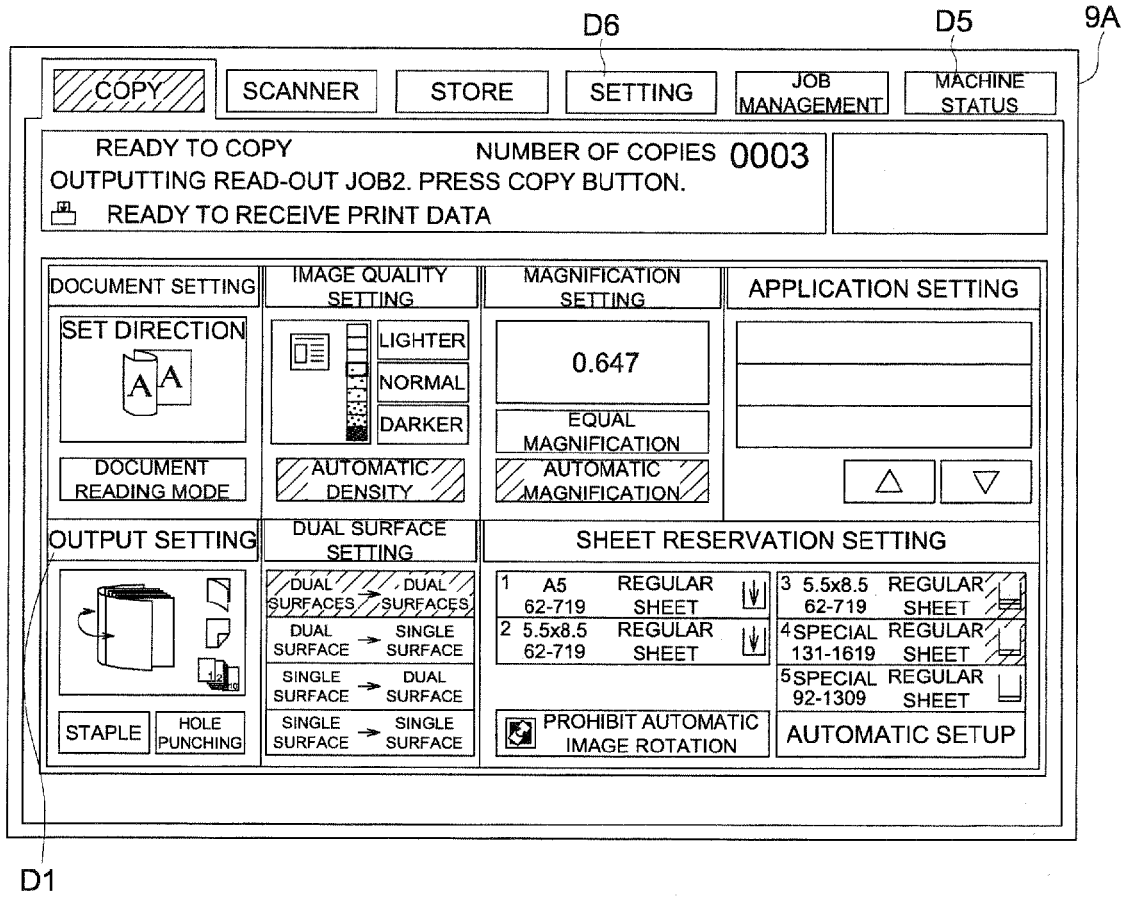
FIG. 4 illustrates a detail view of a display screen in an operation display section 9A of the image forming apparatus A.
Figure 6:
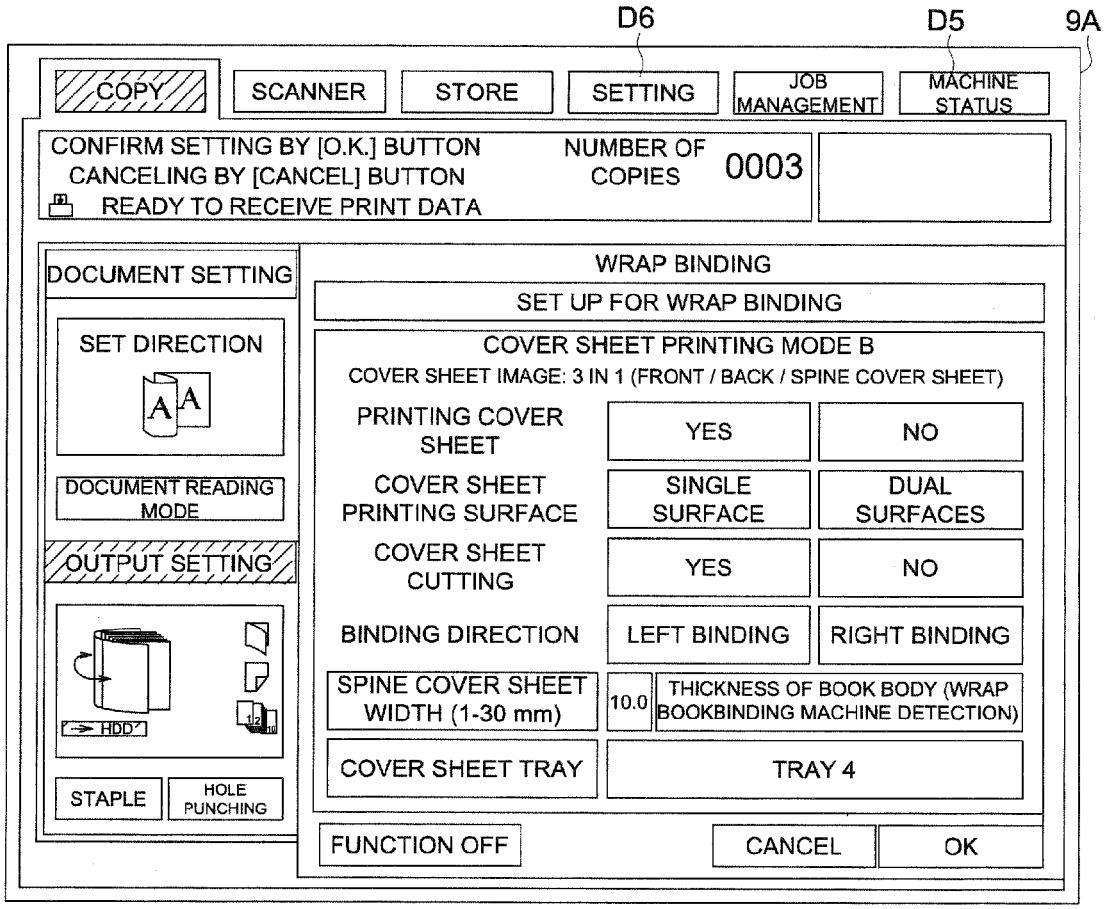
FIG. 6 illustrates a detail view of the display screen in the operation display section 9A of image forming apparatus A.

Next, a setting method of the bookbinding processing (may also be said as a wrap binding process hereinafter) is explained. FIG. 4 or 6 illustrates detail views of the display screen in the operation display section 9A of the image forming apparatus A. FIG. 4 shows the basic screen of the operation display section 9A for performing various kinds of displays and inputs. In the basic screen, selections of a document setting, of an image quality setting, of an output setting, of an application function and of a sheet feeding tray for sheet feeding the sheet are performed.

Figure 5:
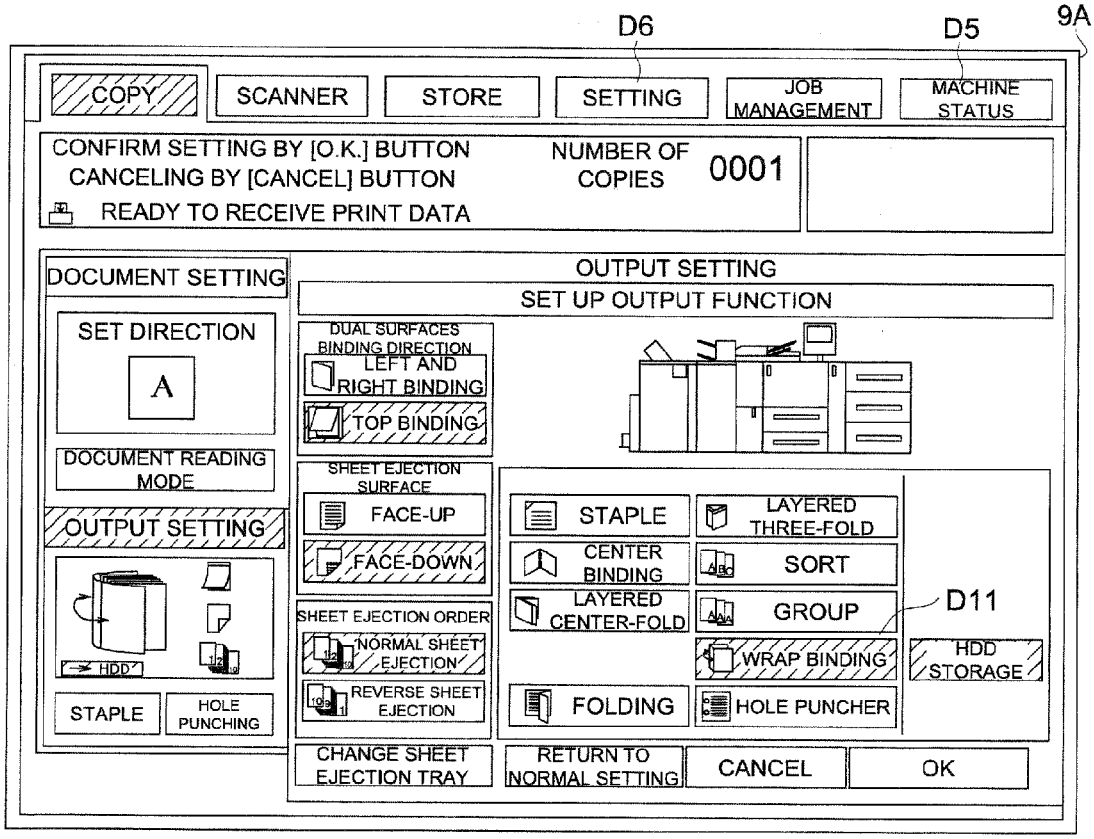
FIG. 5 illustrates a detail view of the display screen in the operation display section 9A of the image forming apparatus A.

In case when executing the bookbinding process, an output setting button D1 is pressed in FIG. 4. In case when the output setting button D1 is pressed, a setting screen relating to the output setting is displayed as popup as shown in FIG. 5. In case when a wrap binding button D11 is pressed in the output setting screen, a wrap binding setting screen of FIG. 6 is displayed as popup.

On the wrap binding setting screen in FIG. 6, an existence of a cover sheet printing, a selection of a cover sheet printing mode (single surface/dual surface), a cover sheet printing surface, an existence of a cover sheet cutting, a binding direction, spine cover sheet width and a cover sheet tray are set, and the setting is completed by pressing OK button.

[PB Heater Control]

Figure 7:
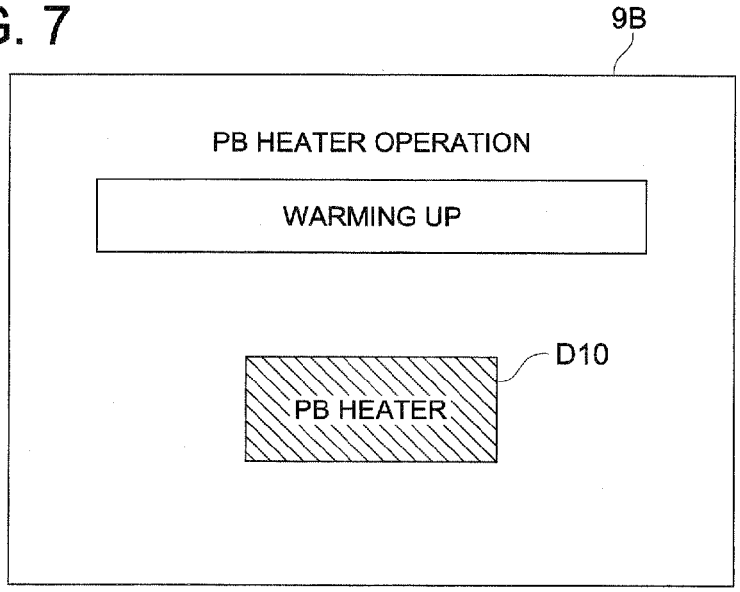
FIG. 7 illustrates a detailed screen of an operation display section 9B of the bookbinding apparatus B.
Figure 10:
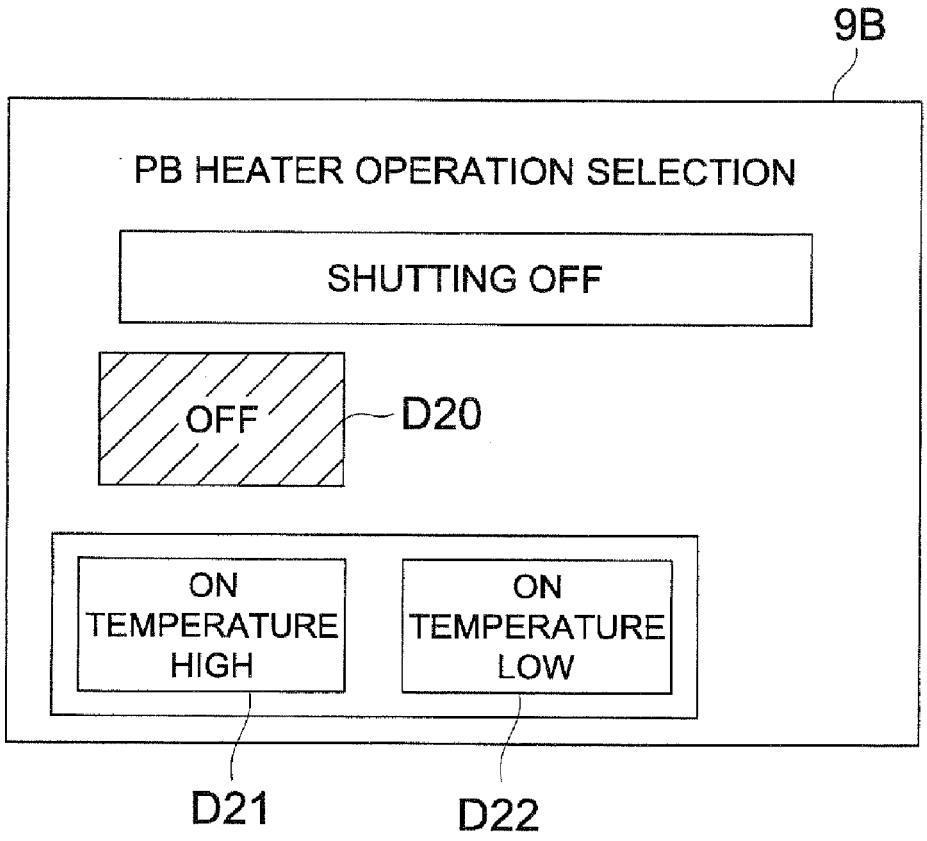
FIG. 10 illustrates a detailed screen of the operation display section 9B of the bookbinding apparatus B in another embodiment.

The control of the heater H for heating the adhesive of the bookbinding apparatus B is explained based on FIG. 7 or 10. FIG. 7 illustrates the detailed screen of the operation display section 9B of the bookbinding apparatus B. The operation display section 9B shown in FIG. 7 functions as an input section for receiving an input of a control condition of a PB heater from a user. Here, PB (Perfect Binder) heater denotes the heater H for heating the above-mentioned adhesive container 53.

Figure 8:
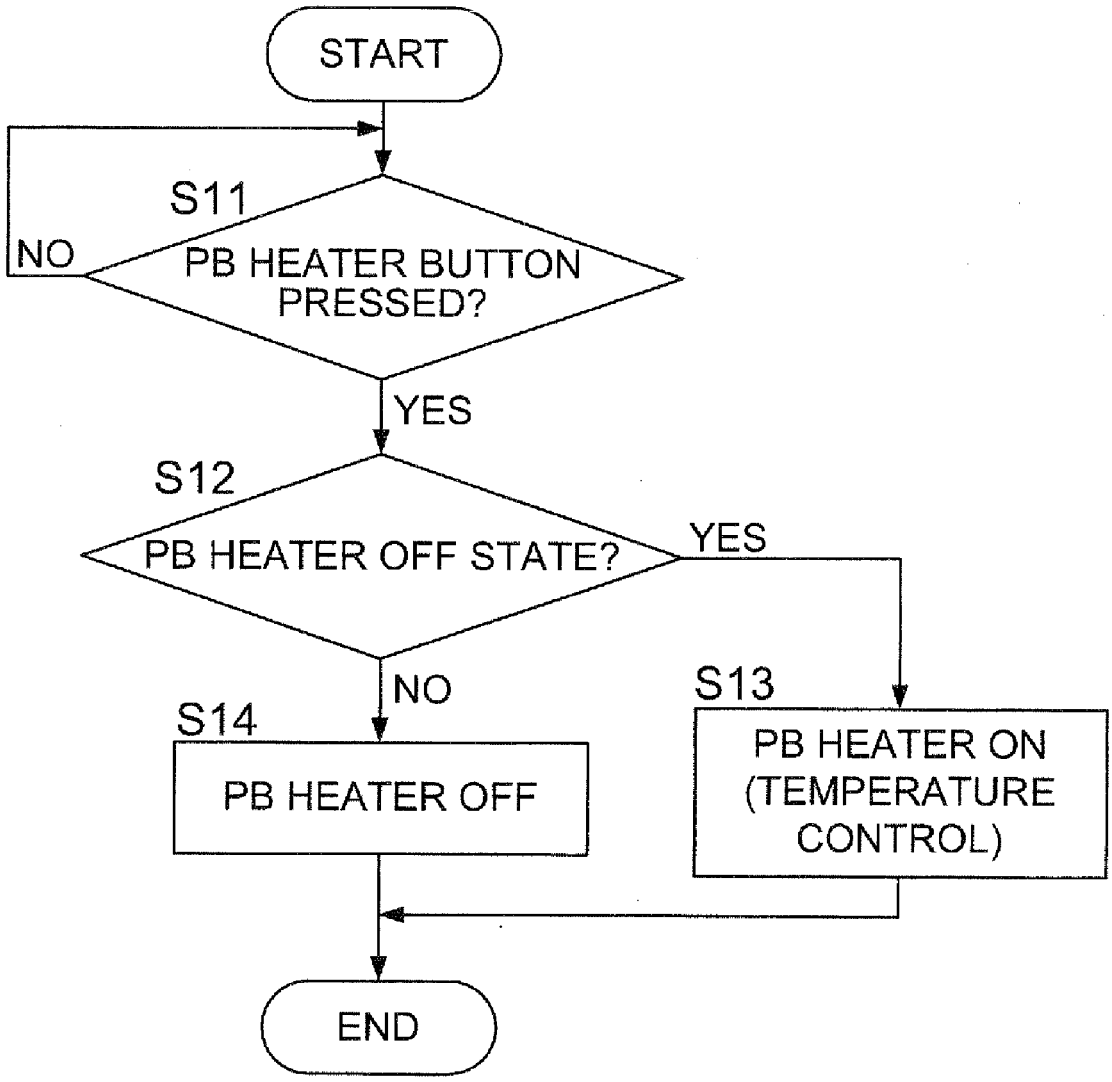
FIG. 8 illustrates a figure indicating the control flow of the bookbinding apparatus of an embodiment.

FIG. 8 illustrates a figure showing a control flow of the bookbinding apparatus pertaining to an embodiment. This control flow is a process to be performed by the CPU 100B functioning as the heater control section of the post processing apparatus. In case when a PB heater button D10 shown at Step S11 in FIG. 7 is pressed (STEP S11: YES), the state of the PB heater is determined in the following STEP S12. In case when the PB heater is in the OFF state where the supply of a power is turned OFF (STEP S12: YES), the PB heater will be changed into ON state (STEP S13).

Accordingly, a temperature control, which switches ON/OFF of the heater H so that the measured value from the temperature detection sensor 501 for measuring the temperature of the adhesive stored in the adhesive container 53 may become a predetermined temperature, is performed.

On the other hand, in case when the PB heater is not in an OFF state (STEP S12: NO), the PB heater will be changed into an OFF state (STEP S14), and it will end.

Figure 9:
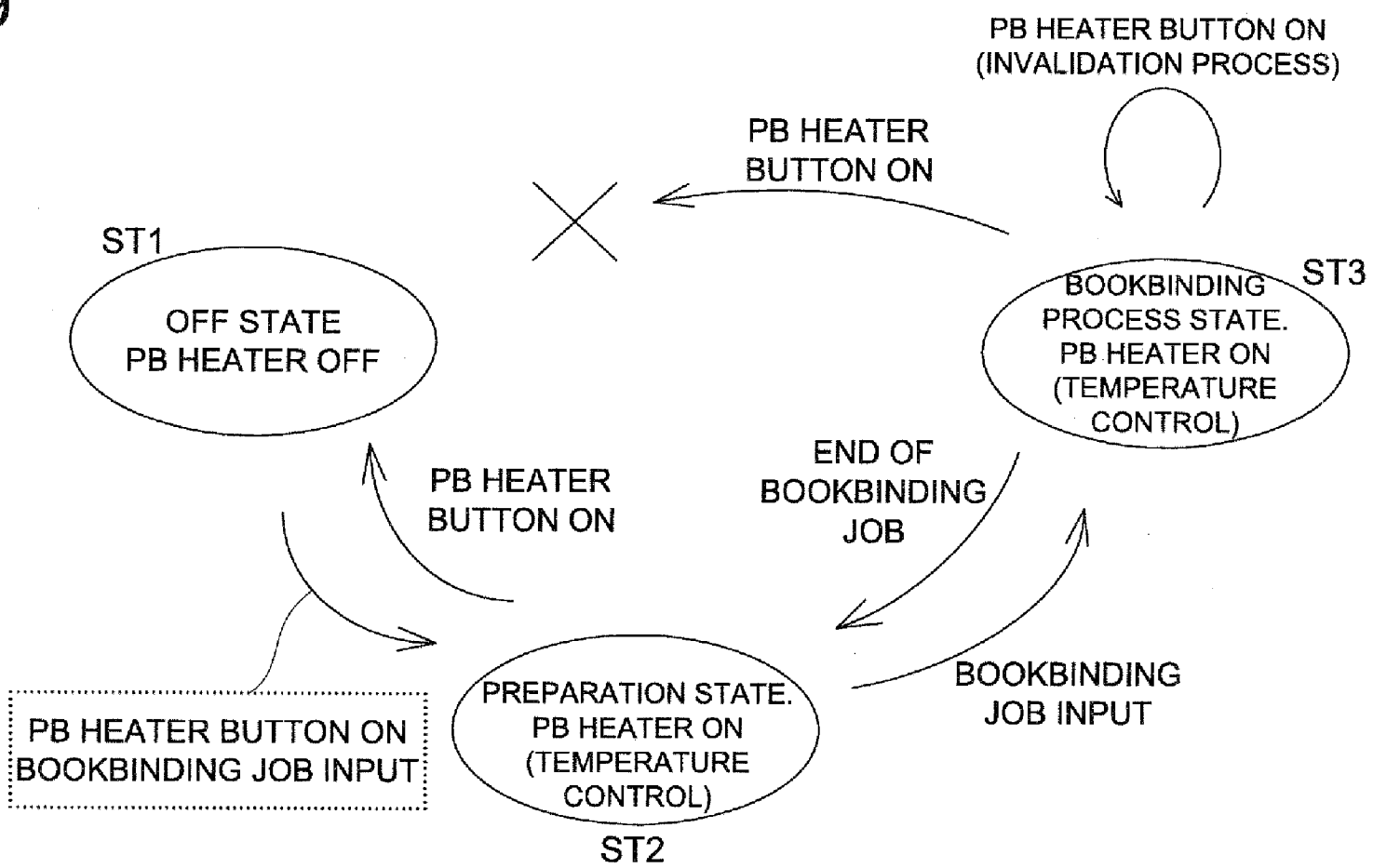
FIG. 9 illustrates a state transition diagram of the bookbinding apparatus B.

Next, a control operation of the bookbinding apparatus B will be explained based on FIG. 9. FIG. 9 illustrates a state transition diagram of the bookbinding apparatus B. The PB heater is turned off in an OFF state ST1. When the PB heater button (D10 in FIG. 7) is turned ON (pressed) from the OFF state ST1, it will shift to a preparatory state ST2. In the preparatory state ST2, the temperature control is performed so as to be at a predetermined temperature by the heater control section turning ON the PB heater. In this preparatory state ST2, when the PB heater button is pressed, it will shift to the OFF state ST1 again.

On the other hand, in the event that the bookbinding apparatus B receives the information that the bookbinding print job (only henceforth a bookbinding job) was inputted via the communication section 104B from the image forming apparatus A, if it is in the OFF state ST1, it will shift to the preparatory state ST2, and the PB heater is operated, and the preparation for receiving is started. In case when the temperature has reached to a predetermined temperature and the adhesive has been melted enough to be in an acceptable state, a process will shift to a bookbinding processing state ST3, and the bookbinding processing will be started. In the bookbinding processing state ST3, while performing the bookbinding processing, the temperature control of the PB heater is performed so that the temperature of adhesive is maintained at a predetermined temperature. When the bookbinding job was completed, the process shifts to the preparatory state ST2 again from the bookbinding processing state ST3.

In this embodiment, although the PB heater button is turned on in the bookbinding processing state ST3, the current state is maintained without turning off the PB heater. Accordingly, an invalidation process of the PB heater button is performed. This is because it is necessary to continuously melt and maintain the temperature of adhesive equal to or more than a predetermined temperature during the bookbinding processing.

Also in any one of state from ST1 through ST3, a sheet conveyance to sub sheet ejection section 20 is arranged to be possible.

Thus, an input section 9B, which receives the input from a user, is also provided, and the heater control section performs a change of the control condition of the heater based on the input from the input section 9B. Based on this arrangement, energy saving and a control of occurrence of the bad smell are promoted by allowing the user to change the temperature control condition of adhesive with a heater. Further, it becomes possible to provide the bookbinding apparatus provided with a usable sub sheet ejection mechanism irrespective to the temperature status of the adhesive.

FIG. 10 illustrates a detailed screen of the operation display 9B of the bookbinding apparatus B in another embodiment. In the example indicated in the FIG. 10, the control state of the PB heater is to be in the "ON" state, and further, the change of the control temperature is set to changeable. When a user chooses various kinds of selection buttons D20-D22, the control condition of the PB heater can be changed.

In FIG. 10, by pressing an OFF button D20, the state shifts to OFF state and the control temperature can be changed by pressing ON buttons D21 and D22. Here "Temperature High" denotes that adhesive is in the temperature in which melting is possible, and the control temperature is set at the highest temperature in which the bookbinding processing is possible immediately. "Temperature Low" denotes that the control temperature is relatively low, and it is insufficient temperature to melt the adhesive. In order to perform the bookbinding processing, it is necessary to warm for predetermined time up. However, warm-up time is shorter than setting to OFF. Since the control temperature is low, the deteriorating degree of the adhesive is lower than "Temperature High", and the occurrence of the bad smell from the adhesive is low.

The various setting buttons illustrated in FIG. 10 perform "cancellation process" which cannot be selected in the bookbinding processing state ST3. Accordingly, in the event that the execution instruction of a bookbinding job is received from the communication section 104, the CPU 101B, functioning as the heater control section, controls not to receive the change of the control condition of the PB heater.

[Image Forming System]

Next, the image forming system, which changes the control condition of the PB heater based on the input from the operation display section 9A as an input section provided in the image forming apparatus will be explained.

Figure 11:
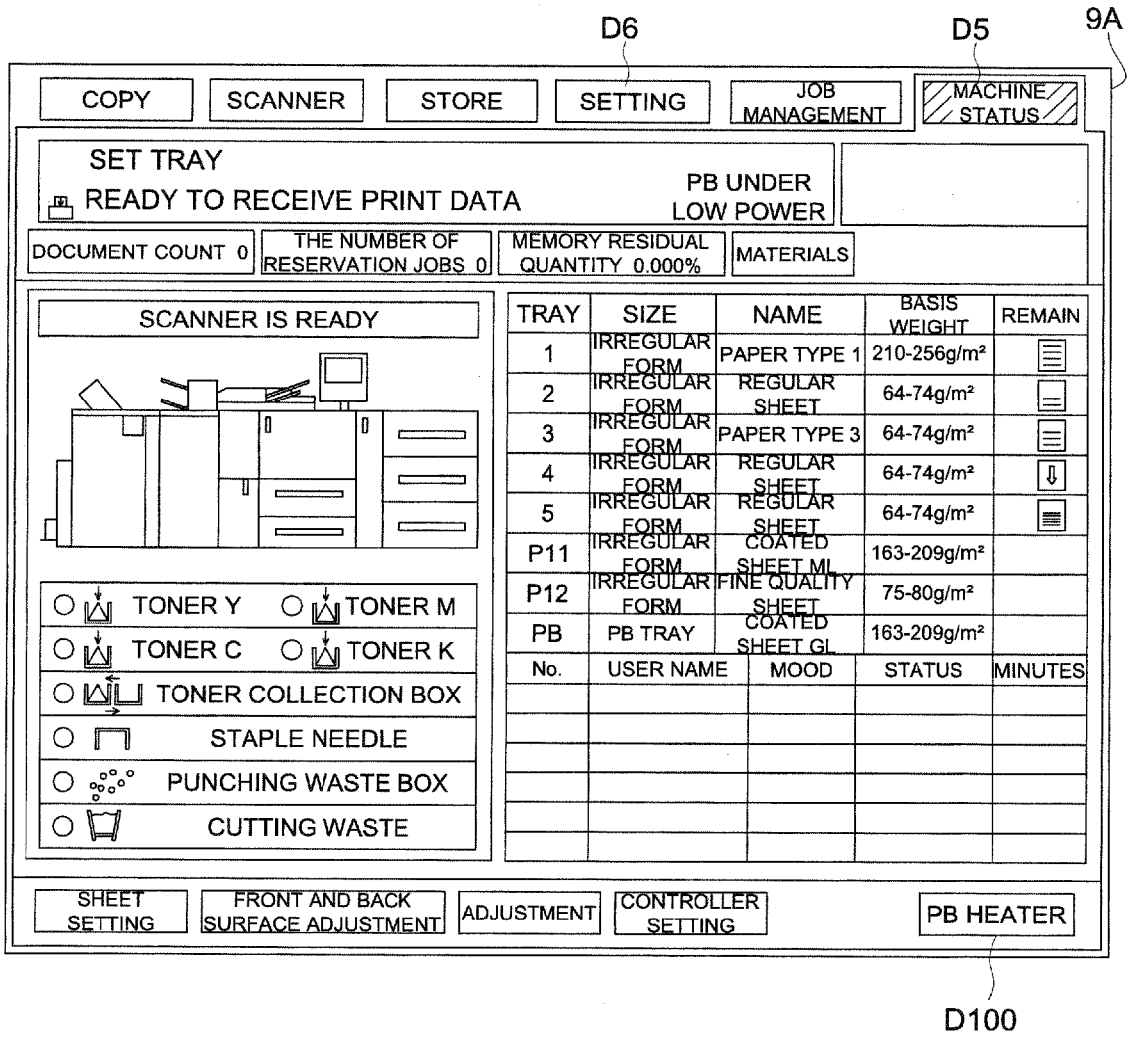
FIG. 11 illustrates a detail view of the display screen in the operation display section 9A of the image forming apparatus A.

In the display screen of above-mentioned FIGS. 4-6, when pressing a machinery status button D5, the display screen displays the machinery status of FIG. 11. In FIG. 11, a PB heater button D100 of the image forming apparatus A corresponds to the PB heater button D10 of the bookbinding apparatus B in FIG. 7. By operating the PB heater button D100, the heater control section of the bookbinding apparatus B can perform the same control as FIGS. 8 and 9.

Figure 12:
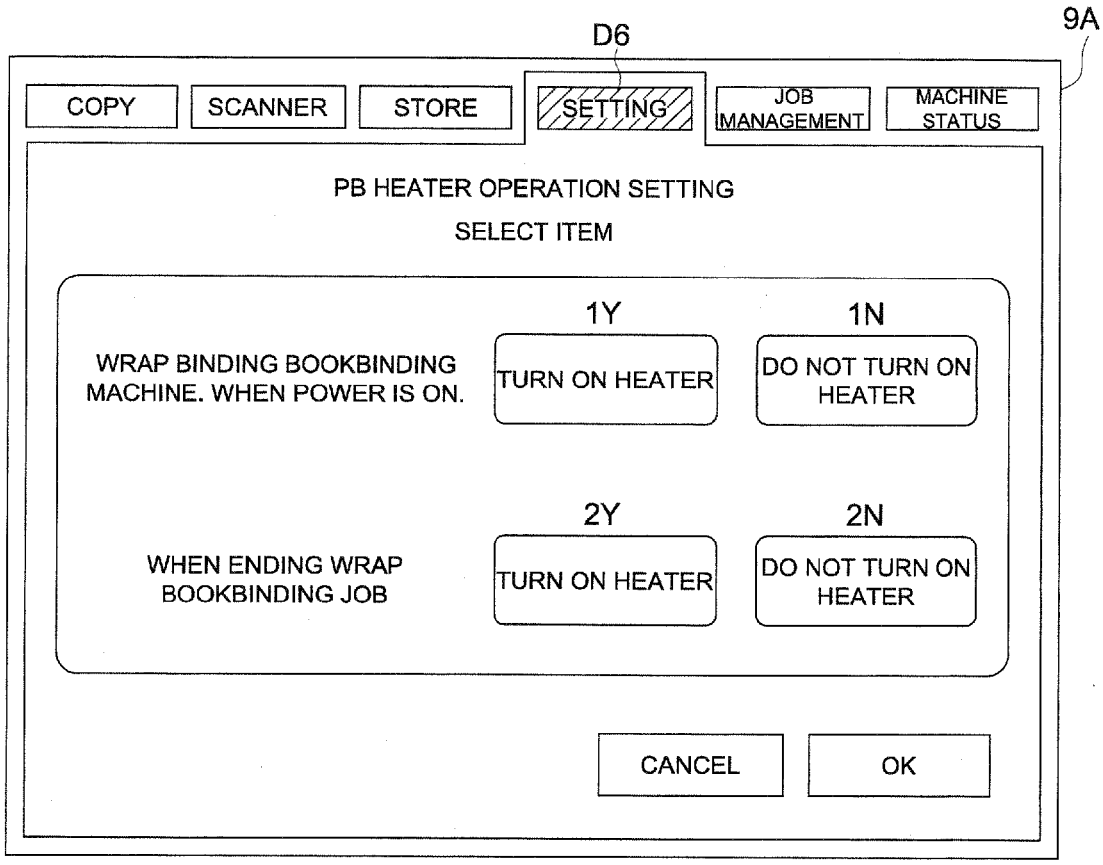
FIG. 12 illustrates a detail view of the display screen in the operation display section 9A of the image forming apparatus A.

FIG. 12 shows the screen for setting the control condition of the PB heater. This screen is displayed by pressing a setting button D6 in the display screen of above-mentioned FIGS. 4-6. In FIG. 12, the control condition of the PB heater can be determined, when the (entire) electric power switch of bookbinding apparatus B is turned on by a 1Y button or a 1N button.

A 2Y button or 2N button can determine the control condition of the PB heater at the time of the end of the bookbinding print job. After choosing either button, it will be confirmed by pressing an O.K. button. The confirmed control condition is stored in a setting storage section 103B, which functions as a storage section.

Figure 13:
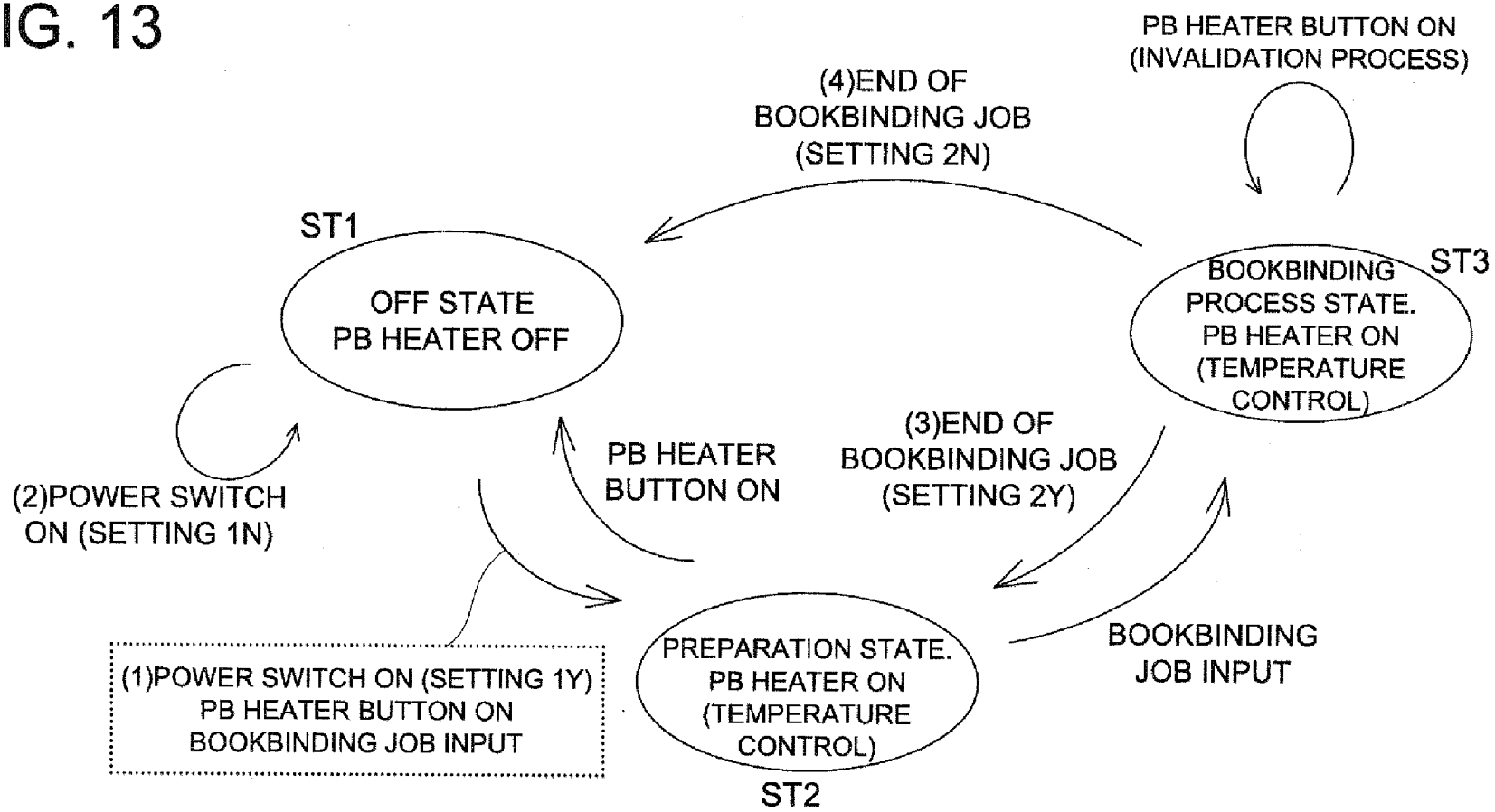
FIG. 13 illustrates a state transition diagram of the image forming system.

FIG. 13 illustrates a state transition diagram of the image forming system. The example illustrated in the FIG. 13 explains the processing in the bookbinding apparatus B of the image forming system, which has a setting screen as illustrated in FIGS. 11 and 12. The explanation of the common section in FIGS. 9 and 13, which is a modification from FIG. 9, will be omitted.

In the event that the electric power switch is turn on, in the OFF state ST1 in which the electric power switch and the PB heater of the bookbinding apparatus B are turned off in FIG. 13, the heater control section changes the state to be shifted by the setting of 1Y button and 1N button illustrated in FIG. 12. (1) In the event that the 1Y button is set, the state shifts to the preparatory state ST2 from the OFF state ST1. (2) In the event that the 1N button is set, the OFF state ST1 is maintained. As illustrated in the FIG. 12, the shift between the OFF state ST1 and the preparatory state ST2 can be mutually conducted also by pressing the PB heater button D100.

In the event that the bookbinding job is completed in the bookbinding processing state ST3, the heater control section changes the state of shifting by the setting the 2Y button and the 2N button illustrated in FIG. 12. (3) In the event that the bookbinding job is completed, the state is shifted to the preparatory state ST2 from the bookbinding processing state ST3, in the event that 2Y button is set. (4) In the event that a bookbinding job is completed, the state is shifted to the OFF state ST1, in the event that the 2N button is set. In the event of shifting to the OFF state ST1, the predetermined time may be arranged so that the state is shifted to the preparatory state ST2, and shifted to the OFF state ST1 after having passed, for example, 1 minute as a predetermined time.

According to the embodiment of the present invention, by making the temperature control condition of the adhesive by a heater easily changeable, it becomes possible to attain the promotion of the energy saving and the control of the occurrence of the bad smell. At the same time, it becomes possible to provide the image forming system provided with the usable sub sheet ejection mechanism irrespective to the temperature status of the adhesive.

What is claimed is:

1. A bookbinding apparatus which is attachable to an image forming apparatus and which performs bookbinding by adhering a cover sheet onto a spine of a sheet bundle formed by a plurality of sheets on each of which an image has been formed by the image forming apparatus, the bookbinding apparatus comprising:

a coating section for coating adhesive onto the spine of the sheet bundle by moving relatively to the spine of the sheet bundle;

a heater for heating the adhesive;

a temperature detection section for detecting a temperature of the adhesive;

a direct heater power supply input section which receives an input to turn OFF/ON a power supply to the heater from a user; and a heater control section for controlling the heater based on a detection result of the temperature detection section so that the temperature of the adhesive becomes a predetermined control temperature, and changing a control condition of the heater based on the user input from the direct heater power supply input section, wherein when the user input is accepted by the direct heater power supply input section, the heater control section: (i) judges whether the power supply to the heater is in an ON state or an OFF state, and (ii) executes an operation of turning the power supply to the heater to the other of the ON state and the OFF state from the state of the power supply to the heater judged by the heater control section directly based on the user input, and wherein, while the coating section is coating the adhesive onto the spine of the sheet bundle, the heater control section does not turn OFF the power supply to the heater even when the direct heater power supply input section receives the input to turn OFF/ON the power supply.

2. The bookbinding apparatus according to claim 1, further comprising:

a sub sheet ejection mechanism which ejects a sheet without bookbinding, and which has an independent sheet ejection pathway that does not pass through the coating section.

3. The bookbinding apparatus according to claim 1, further comprising a control temperature input section which receives a user input to selectively change a control temperature of the adhesive.

4. The bookbinding apparatus according to claim 1, further comprising a communication section, wherein the heater control section does not turn OFF the power supply to the heater when the bookbinding apparatus receives an execution instruction of a bookbinding job from the image forming apparatus via the communication section.

5. The bookbinding apparatus according to claim 1, further comprising a communication section, wherein the heater control section does not change the control condition of the heater when the bookbinding apparatus receives an execution instruction of a bookbinding job from the image forming apparatus via the communication section.

6. The bookbinding apparatus according to claim 1, further comprising a storage section which stores the control condition of the heater, wherein the heater control section decides the control condition of the heater at a time when a power switch of the bookbinding apparatus is turned ON, based on the control condition stored at the storage section.

7. The bookbinding apparatus according to claim 6, wherein the heater control section decides the control condition of the heater at a time when a bookbinding job is completed, based on the control condition stored at the storage section.

8. The image forming system according to claim 1, wherein the heater control section does not turn OFF the power supply to the heater when an execution instruction of a bookbinding job is input.

9. The image forming system according to claim 1, wherein the heater control section does not change the control condition of the heater when an execution instruction of a bookbinding job is input.

10. The bookbinding apparatus according to claim 1, further comprising an operation display section which includes an operation selection button that selects the control condition of the heater, wherein the user input is executed through the operation selection button.

* * * * *